US007814833B1

(12) United States Patent
Land

(10) Patent No.: US 7,814,833 B1
(45) Date of Patent: Oct. 19, 2010

(54) DETONATOR SYSTEM HAVING LINEAR ACTUATOR

(75) Inventor: David G. Land, Greenfield, IN (US)

(73) Assignee: Raytheon Company, Waltham, MA (US)

( * ) Notice: Subject to any disclaimer, the term of this patent is extended or adjusted under 35 U.S.C. 154(b) by 460 days.

(21) Appl. No.: 12/025,212

(22) Filed: Feb. 4, 2008

Related U.S. Application Data

(63) Continuation of application No. 10/824,156, filed on Apr. 14, 2004, now Pat. No. 7,451,700.

(51) Int. Cl.
*C06C 5/06* (2006.01)
*F42D 1/045* (2006.01)

(52) U.S. Cl. ..... 102/275.6; 102/275.11

(58) Field of Classification Search ..... 102/202.5, 102/275.6, 275.11, 220, 218, 322
See application file for complete search history.

(56) References Cited

U.S. PATENT DOCUMENTS

| | | | | |
|---|---|---|---|---|
| 2,825,863 | A | 10/1954 | Krupen | |
| 2,998,775 | A | 2/1956 | Craft | |
| 3,078,803 | A | 2/1963 | Margraf et al. | |
| 3,171,913 | A | 3/1965 | Kersh | |
| 3,250,034 | A | 5/1966 | Simmons | |
| 3,343,490 | A * | 9/1967 | Barrett | 102/272 |
| 3,630,482 | A | 12/1971 | Beller | |
| 3,632,081 | A | 1/1972 | Evans | |
| 3,721,471 | A | 3/1973 | Bergmann et al. | |
| 3,792,663 | A | 2/1974 | Schneider, Jr. | |
| 3,877,373 | A | 4/1975 | Bergmann et al. | |
| 4,381,711 | A | 5/1983 | Lawrence | |
| 4,393,779 | A | 7/1983 | Brede et al. | |
| 4,458,594 | A * | 7/1984 | Weber et al. | 102/240 |
| 4,478,149 | A | 10/1984 | Backstein et al. | |
| 4,577,561 | A | 3/1986 | Perry | |
| 4,674,047 | A | 6/1987 | Tyler et al. | |
| 4,852,496 | A | 8/1989 | Campagnuolo et al. | |
| 4,953,616 | A | 9/1990 | Borden et al. | |
| 4,962,708 | A | 10/1990 | Snyder et al. | |
| H001068 | H | 7/1992 | Huhmann | |
| 5,383,388 | A | 1/1995 | Ono | |
| 5,417,162 | A | 5/1995 | Adams et al. | |
| 5,460,093 | A | 10/1995 | Prinz et al. | |
| 5,488,908 | A | 2/1996 | Gilpin et al. | |
| 5,511,978 | A | 4/1996 | Sellers, Jr. et al. | |

(Continued)

FOREIGN PATENT DOCUMENTS

| | | |
|---|---|---|
| JP | 6271380 | 9/1994 |

*Primary Examiner*—Troy Chambers
(74) *Attorney, Agent, or Firm*—Renner, Otto, Boisselle & Sklar, LLP

(57) ABSTRACT

Disclosed is a detonation initiator that can form part of a demolition assembly. The detonation initiator can include a linear actuator assembly having a core with a permanent magnet disposed with respect to a coil, and a firing pin coupled to the core and disposed along a longitudinal axis of the linear actuator assembly. A capacitor can be used to store electrical energy derived from an electrical pulse received by the detonation initiator. An electrical circuit can be used to monitor the charge on the capacitor and to discharge the capacitor through the coil of the linear actuator assembly to propel the core along the longitudinal axis of the linear actuator assembly when the charge on the capacitor reaches a charge threshold.

22 Claims, 5 Drawing Sheets

U.S. PATENT DOCUMENTS 5,546,862 A 8/1996 Schabdach
5,564,747 A * 10/1996 Ono et al. ..... 280/806
5,714,709 A 2/1998 Schillinger et al.
6,218,922 B1 4/2001 Clark et al.
6,272,996 B1 8/2001 O'Brien et al.
6,422,145 B1 7/2002 Gavrilovic
6,546,873 B1 4/2003 Andrejkovics et al.
6,581,519 B1 6/2003 Adams
6,867,512 B2 3/2005 Delaire et al.
6,966,761 B1 11/2005 Roke et al.
2003/0070571 A1 4/2003 Hodge et al.

* cited by examiner

DETONATOR SYSTEM HAVING LINEAR ACTUATOR

RELATED APPLICATION DATA

This application is a continuation of U.S. patent application Ser. No. 10/824,156, filed Apr. 14, 2004, the disclosure of which is herein incorporated by reference in its entirety.

TECHNICAL FIELD

The present invention generally relates to an apparatus that can be used to remotely initiate the detonation of explosives and, more particularly, to a detonation initiation system that includes a linear actuator assembly to activate a blasting assembly, such as a shock tube.

BACKGROUND

Remote activation systems for detonating explosives have been used widely in the field of military and industrial demolition applications. In the past, demolition initiation devices have been used to generate an electrical impulse for initiating detonation. For example, a blasting cap used in conjunction with an explosive charge (e.g., C4) can be electrically connected to output terminals of the initiation device using electrical conductors. In many instances, the conductors can be several hundred meters long to separate the initiation device and the explosive. In this arrangement, the assembly is sensitive to electrical conditions, such as electromagnetic interference (EMI) and/or electrostatic discharge (ESD). As a result of this sensitivity, premature detonation of the explosive charge has been known to occur with unacceptable frequency. The results of premature detonation can include unintended damage and/or unintended personal injury or death.

At least one attempt has been made to avoid using electrical conductors to deliver explosion initiating energy from the initiation device to the explosive change. In this attempt a mechanical arm driven by a solenoid was used to initiate a device that propagates a chemical reaction from initiator to explosive. As used herein, chemical reaction or chemical energy includes the burning or exploding of a given material.

Such an attempt is described in U.S. Pat. No. 6,546,873, which discloses a transmitter that transmits a detonation signal to a receiver. The receiver can be configured to deliver an electrical output in response to a received detonation signal. Such electrical output can be used to electrically excite a blasting cap via conductors. But, as indicated above, if the conductors have any appreciable length (e.g., 50 meters or more), ambient electrical conditions (e.g., an atmospheric electrical storm) can cause premature detonation of the explosive. The receiver can alternatively be used to actuate the solenoid/mechanical arm assembly mentioned above. However, electrical signals output by the RAMS receiver have low power levels and testing by the Army Research Lab has determined that solenoid based mechanical actuators do not perform with enough reliability to be deployed in the field.

Accordingly, there exists a need in the art for an explosion initiating assembly that has reduced sensitivity to electrical conditions and can reliably initiate a chemical energy propagation assembly when powered by a low level electrical power source.

SUMMARY OF THE INVENTION

According to one aspect of the invention, the invention is directed to a detonation initiator. The detonation initiator can include a linear actuator assembly having a core with a permanent magnet disposed with respect to a coil, and a firing pin coupled to the core and disposed along a longitudinal axis of the linear actuator assembly; a capacitor for storing electrical energy derived from an electrical pulse received by the detonation initiator; and an electrical circuit for monitoring charge on the capacitor and discharging the capacitor through the coil of the linear actuator assembly to propel the core along the longitudinal axis of the linear actuator assembly when the charge on the capacitor reaches a charge threshold.

According to another aspect of the invention, the invention is directed to a demolition assembly. The demolition assembly can include a detonation initiator having a linear actuator assembly and a receiver for outputting an electrical pulse that activates the detonation initiator in response to a detonation signal transmitted to the receiver.

BRIEF DESCRIPTION OF DRAWINGS

These and further features of the present invention will be apparent with reference to the following description and drawings, wherein.

DISCLOSURE OF INVENTION

Figure 1:
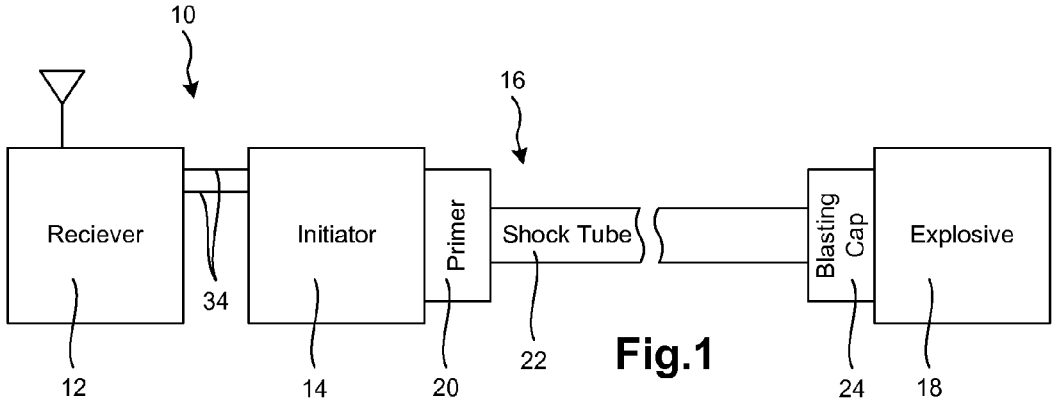
FIG. 1 is a block diagram of a demolition assembly according to various aspects of the invention.

In the detailed description that follows, similar components have been given the same reference numerals, regardless of whether they are shown in different embodiments of the present invention. To illustrate the present invention in a clear and concise manner, the drawings may not necessarily be to scale and certain features may be shown in somewhat schematic form.

Aspects of the invention are directed to a detonation initiator that receives an electrical pulse. The electrical pulse commences a firing routine carried out by the detonation initiator. In particular, energy from the electrical pulse is stored and then discharged to actuate a linear actuator assembly. The linear actuator assembly includes a firing pin that initiates firing of a chemical energy propagation assembly, such as a shock tube assembly. Once activated, the chemical energy propagation assembly delivers chemical energy to an explosive charge, thereby resulting in detonation of the explosive charge.

Referring initially to FIG. 1, shown is a block diagram of a demolition assembly 10. The demolition assembly 10 can include a receiver 12, a detonation initiator 14, a chemical energy propagation assembly 16, and an explosive charge 18. In one embodiment, the chemical energy propagation assembly 16 can be a shock tube assembly that can include a primer 20, a shock tube 22 and a blasting cap 24. Accordingly, the demolition initiator 14 will also be referred to herein as a shock tube initiator 14 and the chemical energy propagation assembly 16 will also be referred to herein as a shock tube assembly 16. However, it should be appreciated that other non-chemical and chemical energy propagation assemblies can be used in the demolition assembly 10 and that the detonation initiator 14 is not limited to firing a shock tube.

In one embodiment, the receiver 12 can be a battery powered receiver component from a remote activation munitions system (RAMS). The RAMS assembly is described in greater detail in U.S. Pat. No. 6,546,873, which is herein incorporated by reference in its entirety. As will be appreciated by those having ordinary skill in the art, the receiver 12 need not form part of a RAMS assembly. Rather, the receiver 12 can be comprised of any device that is connectable to or integral with the shock tube initiator 14 and can deliver an electrical pulse for activating the shock tube initiator 14. In this regard, the receiver 12 need not perform a signal receiving function. Nevertheless, the invention will be described in the exemplary context of using a RAMS receiver component as the receiver 12.

Conventionally, the RAMS receiver component is used to receive a detonation signal from a RAMS transmitter component, such as a wireless RF signal received by an antenna of the RAMS receiver. In response to the detonation signal, the RAMS receiver outputs an electrical signal at a pair of terminals (e.g., about 54 volts for about 100 milliseconds). The terminals are connected to electrical conductors to transmit the output electrical energy to an explosion initiating element, such as an electrically responsive blasting cap. The explosion initiation element can be used to detonate an explosive charge. This arrangement has been proven to initiate an explosion, but is susceptible to electrical conditions and potential premature firing in the manner described above.

In another mode, the RAMS receiver can output an alternate signal at the terminals (referred to in U.S. Pat. No. 6,546,873 as an "M position") rather than the output electrical energy used to activate an electrically responsive explosion initiation element. The alternate signal output by RAMS receivers currently used by the U.S. Army consists of a DC voltage of about 50 volts to about 54 volts that lasts more than three seconds, but less than ten seconds. In one embodiment, the alternate signal lasts for approximately eight seconds and is output across terminals having an output impedance of about 750 ohms. The actual voltage of the alternate signal is dependent on the condition of the battery powering the RAMS receiver. It has been found that the alternate signal has been unsuccessful at initiating detonation of the explosive charge using other techniques. For example, attempts to actuate a solenoid driven mechanical arm to initiate an attached explosion initiation device with the low level electrical energy delivered by the RAMS receiver have failed to produce reliable results.

With the foregoing in mind, the shock tube initiator 14 is arranged to receive an electrical pulse from the receiver 12. In the example embodiment where a RAMS receiver is used as the receiver 12, the electrical pulse can be comprised of the alternate, "M position" signal. The shock tube initiator 14 can be physically mounted to the receiver 12, such as with clips or threaded fasteners. Input electrical terminals 26 (FIG. 2) of the shock tube initiator 14 can be electrically coupled to output terminals of the receiver 12.

With continued reference to FIG. 1, the electrical pulse input to the shock tube initiator 14 activates electrical circuitry of the shock tube initiator 14. As will be described in greater detail below, energy from the electrical pulse is stored. When a threshold amount of energy is stored, the stored energy is discharged though a linear actuator assembly having a firing pin that mechanically strikes the primer 20 of the shock tube assembly 16. Striking the primer 20 in this manner results in chemical activation of the primer 16. The primer 16 is connected to a proximal end of the shock tube 22. Combustion of the primer 16, in turn, begins chemical activation of the shock tube 22 (e.g., ignition of combustible material of the shock tube 22). The shock tube 22 can comprise a flexible plastic tube having a combustible filament disposed in and running the length of the tube. The shock tube 22 can be several meters long to hundreds of meters long. At a distal end of the shock tube 22, the shock tube 22 can be connected to the blasting cap 24. The shock tube 22 conveys chemical energy to the blasting cap 24 that activates combustion of the blasting cap 24. Combustion of the blasting cap 24 detonates the explosive charge 18.

The shock tube assembly 16 can be a conventional shock tube assembly 16 where the primer 20, shock tube 22 and blasting cap 24 are integrally fabricated. In one arrangement, the primer 20 can have a threaded housing 28 for threadably mating with a corresponding threaded receptacle or primer holder 30 of the shock tube initiator 14. As should be appreciated, other assemblies that can be activated by the shock tube initiator 14 and for detonating the explosive 18 can be used instead of the illustrated shock tube assembly 16. Accordingly, the initiator 14 is not limited for use with a shock tube assembly 16. Nor does the initiator 14 need to be remotely located from the explosive 18.

As should be apparent, lengthy electrical conductors are not used in the demolition assembly 10. Accordingly, susceptibility to premature firing caused by electrical conditions, such as an atmospheric electrical disturbance, is greatly reduced over the prior art.

Figure 2:
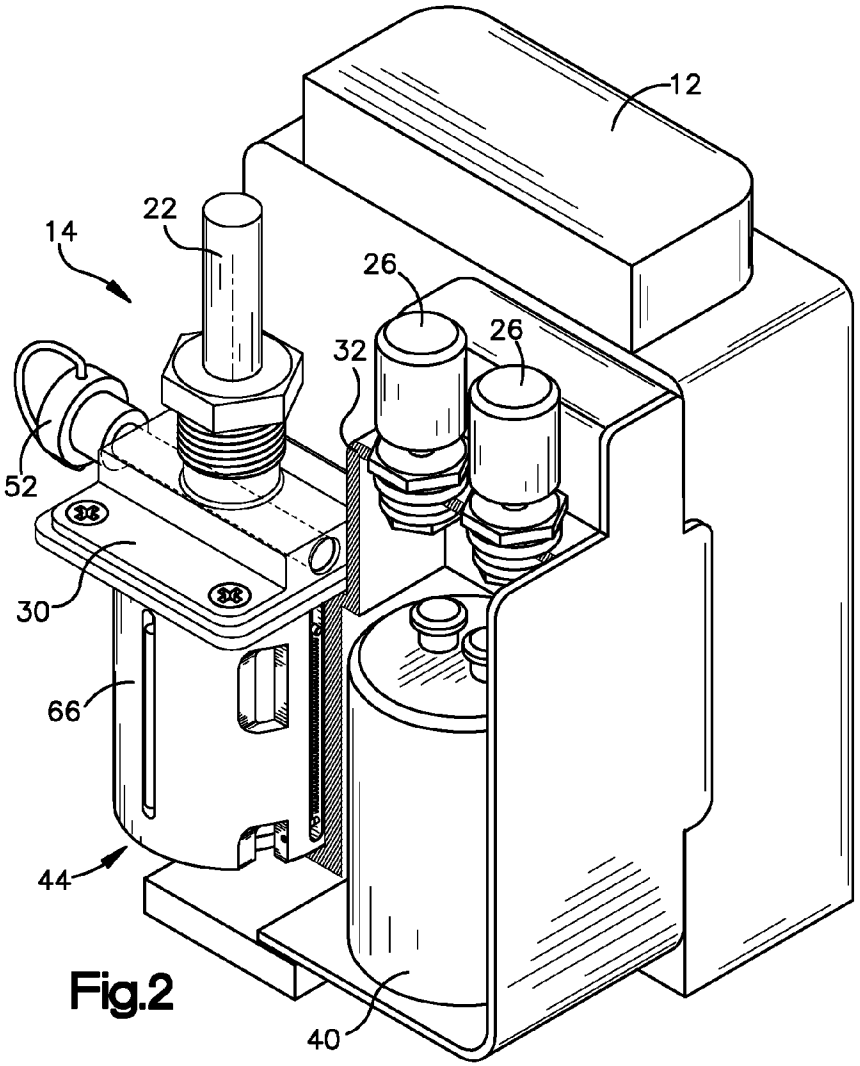
FIG. 2 is a perspective view of a detonation initiator with a housing partially cut away.
Figure 4:
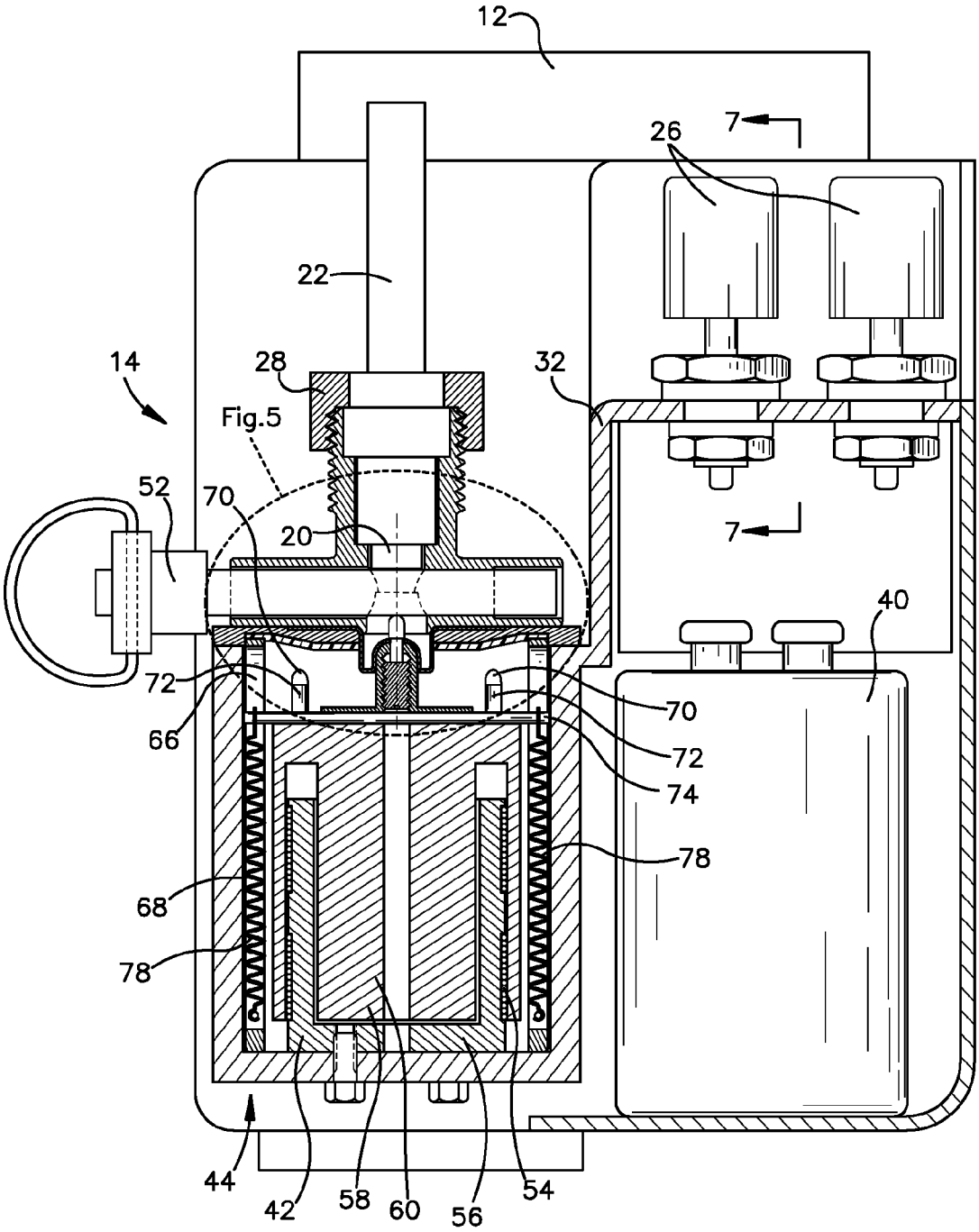
FIG. 4 is a front view of the detonation initiator with the housing partially cut away and a linear actuator assembly shown in cross-section.

With additional reference to FIGS. 2 and 4, shown is a shock tube initiator 14 with a housing 32 partially cut away to show internal components of the shock tube initiator 14. As indicated, the shock tube initiator 14 includes input terminals 26 to which conductors 34 (FIG. 1) can be connected. For example, a first end of each conductor 34 can be captured in a respective terminal 26 by pushing a spring biased knob of the terminal 26 downward, inserting the conductor 34 and releasing the knob to trap the conductor 34 in electrical engagement with the terminal 26. A second end of each conductor 34 can be connected to a respective output terminal of the receiver 12.

Figure 8:
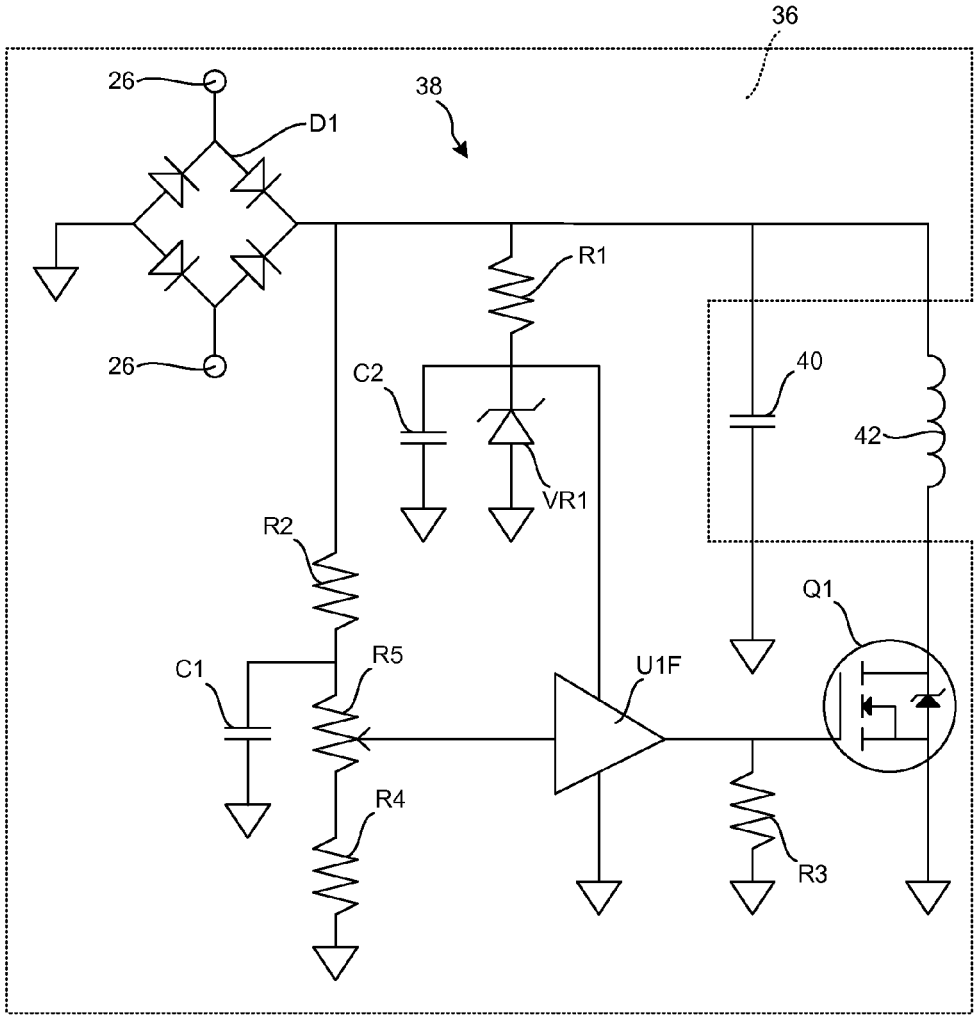
FIG. 8 is an electrical schematic of an electrical circuit of the detonation initiator.
Figure 3:
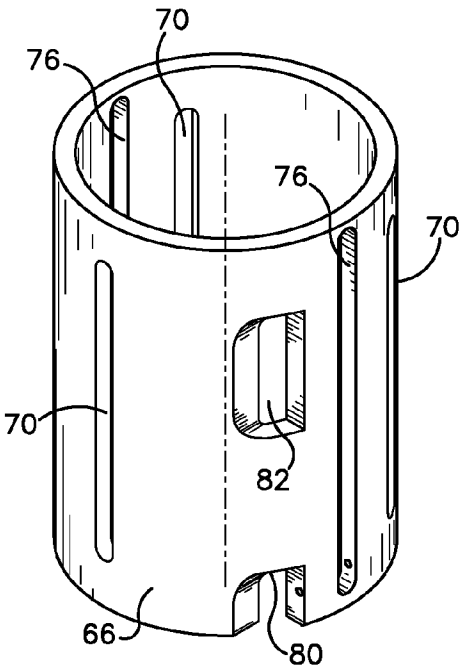
FIG. 3 is a perspective view of a bearing guide component of the detonation initiator.
Figure 7:
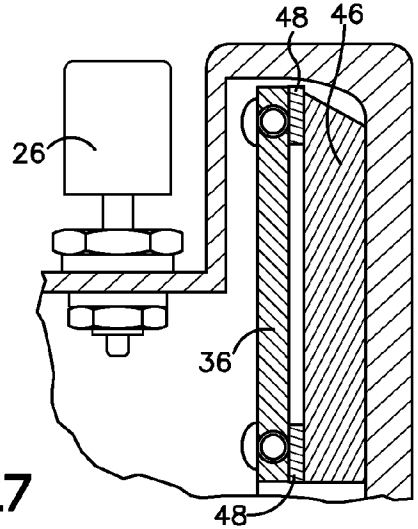
FIG. 7 is a cross-section of a circuit card component of the detonation initiator taken along the line 7-7 of FIG. 4.

With additional reference to FIG. 7, the input terminals 26 are electrically connected to a circuit board 36 that retains components of an electrical circuit 38 (FIG. 8). Operation of the electrical circuit 38 will be described in greater detail below. The electrical circuit 38 includes a main capacitor 40; but, in the illustrated embodiment, the main capacitor 40 is not directly mounted to the circuit board 36. In this embodiment, the main capacitor 40 can be connected the circuit board 36 with conductors and is secured to the housing 28. Also connected to the electrical circuit 36 by way of conductors is a coil 42 of a linear actuator assembly 44. For simplicity of the drawing figures, the conductors between the circuit board 36 and each of the capacitor 40 and the coil 42 have been omitted.

The circuit board 36 can be disposed in a separate chamber from the capacitor 40 and the linear actuator assembly 44. The circuit board 36 chamber can be contained within the housing 32 or, as in the illustrated embodiment, disposed outside the housing 32. The circuit board 36 can be secured to a strong back 46. The strong back 46 can be, for example, a metal plate and serves to minimize flexing of the circuit board 36 during firing of the initiator 14 and during handling of the initiator 14 that could cause shock or vibration. Spacers 48 positioned between the circuit board 36 and the strong back 46 can be used to electrically isolate the circuit board 36 from the strong back 46 and screws inserted through holes of the spacers 48 can be used to mount the circuit board 36 to the strong back 46. In turn, the strong back 46 can be secured to the housing 32 or circuit board 36 chamber wall with screws. The circuit board 36 can be mounted such that when a cover of the circuit board 36 chamber is removed, an adjustable component (e.g., a trimpot) of the electrical circuit 38 is accessible.

Figure 6:
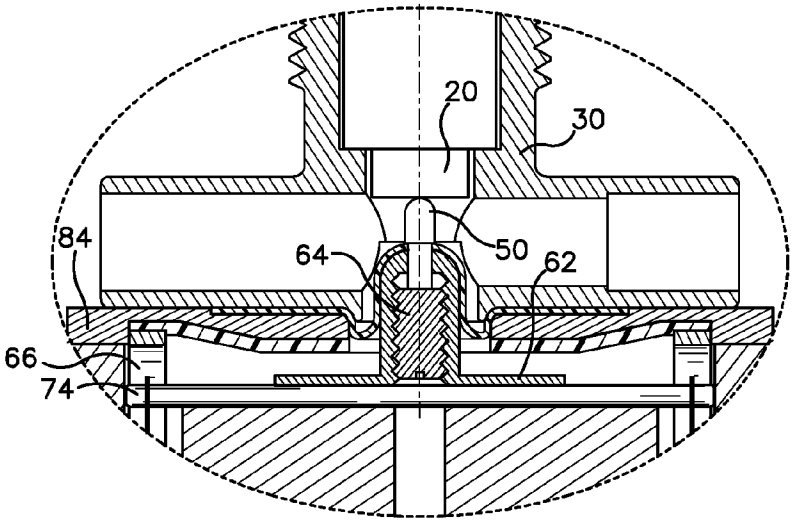
FIG. 6 is an enlarged view of the firing pin area of the linear actuator assembly when the linear actuator assembly is in a firing position.
Figure 5:
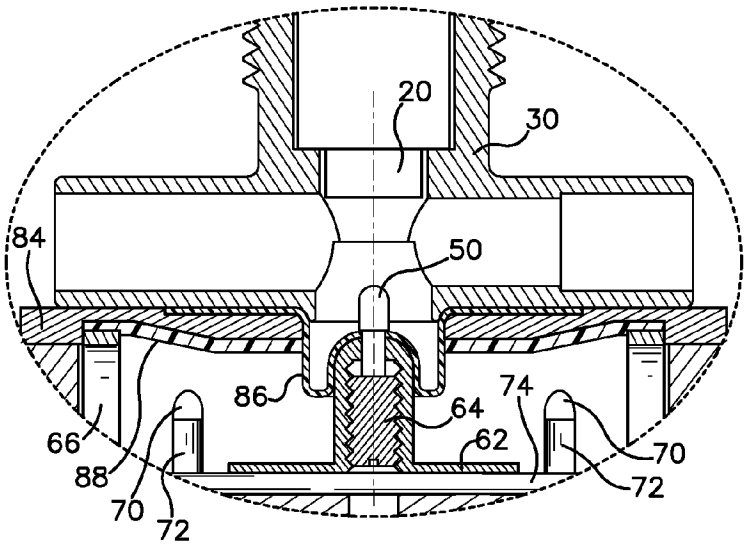
FIG. 5 is an enlarged view of a firing pin area of the linear actuator assembly when the linear actuator assembly is in a starting position.

With additional reference to FIGS. 5 and 6, the linear actuator 44 includes a firing pin 50 that is actuated to impact upon the primer 20 of the shock tube assembly 16. A safety pin 52 can be selectively positioned between the firing pin 50 and the primer 20 to reduce risk of accidental contact between the firing pin 50 and the primer 20. A user can extract the safety pin 52 when the shock tube initiator 14 is to be used in the initiation of a detonation and the user can re-insert the safety pin 52 when initiation of an explosion is not desired.

As indicated, the linear actuator assembly 44 includes a coil 42. The coil 42 can comprise a winding 54 wrapped around a stanchion 56. The stanchion 56 can be made from, for example, aluminum. The stanchion 56 can be secured to the housing 32 (e.g., with the illustrated threaded fasteners) such than during firing of the initiator 14, the stanchion 56, the winding 54 and the conductors that electrically connect the winding 54 to the circuit board 36 have minimal movement with respect to the housing 32. In one embodiment, the stanchion 56 generally defines a hollow cylinder with an open top end and an at least partially covered bottom end (e.g., a bottom end plate of the stanchion 56 can define threaded screw receptacles and a central through hole). An exterior wall of the stanchion 56 can define one or more recesses to receive the winding 54.

The linear actuator assembly 44 also includes a moveable core 58. The core 58 can include a cylindrical inner component connected at an upper end to a concentric outer component to define an annular gap. The core 58 is disposed with respect to the coil 42 such that the cylindrical walls of the coil 42 are located in the annular gap. In a preferred embodiment, the inner component of the core 58 is or includes a permanent magnet 60 and the outer component is connected to the permanent magnet 60, thereby forming a housing for the permanent magnet 60. The housing for the permanent magnet can be made from, for example, steel. The inner component of the core 58 can have a through hole disposed along the longitudinal axis of the core 58.

When voltage is applied to the winding 54 of the coil 42, a magnetic field is formed that propels the core 58 along the longitudinal axis of the linear actuator assembly 44. The illustrated core 58 and coil 42 are similar to a voice coil due to similarities between the core 58 and coil 42 arrangement and the coil and permanent magnet arrangement of common voice coils. However, as indicated, the coil 42 can be secured to the housing 32 to minimize movement of the coil 42 during actuation of the core 58. Accordingly, the conductors connecting the coil 42 to the circuit board 36 can remain generally stationary during actuation of the core 58. As a result, the linear actuator assembly 44 differs from conventional voice coils where a permanent magnet of the voice coil is held stationary and a electrically excitable coil of the voice coil moves in response to electrical excitation. In one embodiment, the coil 42 and core 58 are implemented using a voice coil available from BEI Kimco under model number LA12-17-000A.

Attached to an upper end of the core 58 is a firing pin retainer 62. For example, the firing pin retainer 62 can be screwed to the housing core 58. In one embodiment, the firing pin retainer 58 defines a passage that receives a set screw 64. The set screw 64 retains the firing pin 50 and the set screw 64 can be turned to adjust the vertical position of the firing pin 50. In one embodiment, the firing pin retainer 62 is secured to the core 58 such that the firing pin 40 is disposed along the longitudinal axis of the linear actuator assembly 44. The firing pin 40 can be made from, for example, steel and can have a radiused primer contact end.

With continued reference to each of FIGS. 2-6, the linear actuator assembly 44 can include a generally hollow cylindrical bearing guide 66. The core 58 and coil 42 can be concentrically located in the bearing guide 66. In turn, the bearing guide 66 can be disposed in a generally cylindrical bore 68 defined by the housing 32.

The walls of the bearing guide 66 can define a plurality of vertical through slots 70 that each respectively retain a linear bearing 72. In the illustrated embodiment, the linear bearings 72 extend beyond the interior circumference of the bearing guide 66 to engage the exterior circumference of the core 58. In effect, the linear bearings 72 are disposed between the bore 68 of the housing 32 and the core 58. Substantial movement of the bearings 72 is limited by the bearing guide 66. In other embodiments, the linear bearings 72 can be can be secured to an interior surface of the bearing guide 66 or in recesses of the bearing guide 66.

As indicated, the linear bearings 72 engage a sidewall the core 58. In this manner, the core 58 can be guided along the longitudinal axis of the linear actuator assembly 44 without direct contact with the bearing guide 66. The linear bearings 72 can be made from, for example, PTFE plastic (e.g., TEFLON). The linear bearings 72 can have a relatively low coefficient of friction to allow easy movement of the core 58 with respect to the coil 42. In addition, the linear bearings 72 can compensate for changes in the size of an annular gap between the coil 42 and the core 58 caused by a difference in the rates of thermal expansion between the coil 42 and the core 58. That is, due to a relative large temperature coefficient of the linear bearing 72 the bearing clearance does not change significantly over temperature.

In addition to retaining the firing pin 50, the firing pin retainer 62 can also retain a retraction rod 74. The retraction rod 74 can be disposed in a direction transverse to the longitudinal axis of the linear actuator assembly 44. As best shown in FIG. 4, at least one end of the retraction rod 66 extends beyond an outside circumference of the core 58 and into corresponding slots 76 defined by the bearing guide 66. A spring 78 can be disposed in each slot 76. A first end of the spring 78 can be connected to the retraction rod 74 and a second end of the spring 56 can be connected to the bearing guide 66, using, for example, a pin retained in the slot 76 of the bearing guide 66. After movement of the core 58, tension of the spring 56 can urge the core 58 back along the longitudinal axis of the linear actuator assembly 44 to a starting position (e.g., a position where the firing pin 50 is spaced apart from the primer 20).

A lower edge of the bearing guide 66 can further define a notch 80. The notch 80 can assist in machining a hole in which the spring 78 retention pin is disposed. The notch 80 also serves as a passage for the conductors connecting the winding 54 of the coil 42 to the circuit board 36. In addition, the bore 68 can include a tab that engages the notch 80 to reduce rotation of the bearing guide 66 with respect to the housing 32.

The bearing guide 66 can further define an aperture 82 adjacent an upper edge of the bearing guide 66. Alternatively, the aperture 82 can be defined by the upper edge of the bearing guide 66 in the manner that the illustrated notch 80 is defined by the lower edge of the bearing guide 66. During actuation of the core 58, air can flow through the aperture 82 thereby reducing or eliminating a piston action by the core 58. Air flow may also occur through the slots 70 and 76 and generally around the core 58.

Each of the linear actuator assembly 44 and the a receptacle 30 for the primer 20 can be positioned with respect to the housing 28 such that when a user attaches the primer 20 to the shock tube initiator 14, the firing pin 50 is aligned to strike the primer 20 in a desired location. The receptacle 30 can be secured to the housing 32 with threaded fasteners.

A cap 84 can be trapped between the receptacle 30 and the housing 32. The cap 84 defines a through hole to allow the firing pin to enter the receptacle 30. Trapped between the cap 84 and the receptacle 30 can be a rolling flex seal 86. The seal 86 functions as a membrane between the linear actuator assembly 44 and the primer 20. The seal 86 can conform to an upper surface of the firing pin retainer 62 and moves therewith during actuation of the core 58 as graphically illustrated in FIG. 5 where the linear actuator assembly 44 is in the starting position and FIG. 6 where the linear actuator assembly 44 is in the firing position (e.g., the firing pin 50 is in contact with the primer 20). The seal 86 preferably has a memory such that when the linear actuator assembly 44 returns from the firing position to the starting position, the seal 86 returns to its starting configuration. The surfaces of the receptacle 30 can be rounded to avoid cutting the seal 86 and can be curved to facilitate the memory of the seal 86. An energy absorbing material 88 can be disposed on the underside of the cap 84 to cushion the core 58 and/or firing pin retainer 62 in the event of over-travel of the core 58 (e.g., such as may occur if the initiator were fired when the safety pin 52 and/or primer 20 were not in place).

With additional reference to FIG. 8, shown is a schematic diagram of the electrical circuit 38. The input terminals 26 are connected to a full bridge rectifier D1 in the illustrated manner. In particular, each terminal 26 and the main capacitor 40 is connected to the rectifier D1 such that each terminal 26 is electrically coupled to the main capacitor 40 (as well as the rest of the electrical circuit 38) through a respective diode of the rectifier D1. In this manner, the terminals 26 of the shock tube initiator 14 can be connected in any order to the terminals of the receiver 12 (e.g., either a receiver terminal mark as positive to a terminal 26 marked as positive and a receiver terminal mark as negative to a terminal 26 marked as negative or a receiver terminal mark as positive to a terminal 26 marked as negative and a receiver terminal mark as negative to a terminal 26 marked as positive). As a result, the electrical circuit 38 can operate in a desired manner no matter the connection order.

When an electrical pulse is received from the receiver 12, the main capacitor 40 will begin to charge. At a certain charge threshold, a transistor Q1, such as a power MOSFET, is switched closed such that charge stored by the main capacitor 40 is discharged through the coil 42 of the linear actuator assembly 44. Discharging the stored electrical energy through the coil 42 causes linear movement of the core 58 such that the firing pin 50 impacts the primer 20.

The MOSFET Q1 is controlled by a CMOS buffer U1F. Resistor R1 and voltage reference VR1 function to supply about ten volts to the CMOS buffer U1F. A tunable voltage divider comprised of resistors R2, R4 and R5 are used to set the charge threshold. For example, when the charge stored by the main capacitor 40 reaches a desired amount, such as about 35 volts to about 45 volts, the voltage at the input to the CMOS buffer U1F can approach about five volts. Application of about half the power supply voltage (e.g., the power supply voltage being about ten volts as supplied by resistor R1 and voltage regulator VR1) causes a rail to rail output of the CMOS buffer U1F to transition to a logical high state, which, in the case of the CMOS buffer U1F is about ten volts. The output of the buffer is connected to a gate of MOSFET Q1 to drive the gate at a relatively high voltage (e.g., about ten volts) to rapidly switch on the MOSFET Q1 and create the desired discharge through the coil 42.

The intrinsic nature of the CMOS buffer U1F allows the CMOS buffer U1F to function as a comparitor (e.g., comparing the voltage present on the voltage divider with one half of the voltage supplied to the CMOS buffer U1F by resistor R1 and voltage regulator VR1). Therefore, the CMOS buffer U1F is a digital logic gate that is used in a linear application as an analog comparitor. As should be apparent, in the illustrated embodiment, no additional circuitry is used to establish a reference point to compare against the voltage of the main capacitor 40. In this manner, the electrical circuit 38 can be self contained and derive all operating power from the electrical pulse received from the receiver 12.

The voltage regulator VR1 can be configured as a regulated power supply. As a result, the charge threshold can be accurately set as a comparison of the voltage on the voltage divider versus the power supplied to the CMOS buffer U1F. In this regard, the voltage regulator VR1 can function as a Zener diode with the added feature of temperature compensation.

Capacitors C1 and C2 are used to minimize oscillation of the CMOS buffer U1F. For example, as the main capacitor 40 is effectively shorted to ground through the coil 42 and the MOSFET Q1, the voltage supplied to the CMOS buffer U1F and the voltage on the voltage divider drop at approximately the same rate. Without capacitors C1 and C2, it has been found that the output of the CMOS buffer U1F may begin to oscillate at about 5 kHz to about 10 kHz. The capacitors C1 and C2 at least temporarily compensate for the rapid loss of charge from the main capacitor 40 to minimize oscillation of the CMOS buffer U1F.

As indicated above, if RAMS receiver is used as the receiver 12, the electrical pulse can be about 50 volts to about 54 volts for about eight seconds with an output impedance of about 750 ohms. The available electrical energy from the receiver 12 in this arrangement is relatively low, such as about 2.0 joules to about 2.8 joules. For a typical primer 20, about 0.18 joules of mechanical energy is needed to fire the primer 20. The linear actuator assembly 44 of the illustrated can be configured to have about 2.8 ohms of DC resistance and can convert about twelve percent of the electrical energy applied thereto to mechanical energy. Therefore, given the available output from a RAMS receiver, the shock tube initiator 14 can deliver enough mechanical energy to fire the primer 20.

Other than by way of the rectifier D1, the electrical pulse from the receiver 12 is applied directly to the main capacitor 40. In some applications, a current limiting resistor can be placed between the receiver 12 and the main capacitor 40. However, when a RAMS receiver is used as the receiver 12, the absence of a current limiting resistor is compensated by a limitation of the available current to the main capacitor 12 by the output impedance of the RAMS receiver.

In one embodiment, the main capacitor 40 has a capacitance of about 2,300 micro-Farads. While it is possible to use a capacitor with a larger impedance, it has been found that when the RAMS receiver is used as the receiver 12, the available energy from the electrical pulse is insufficient to charge an appreciably larger capacitor (e.g., about 7,000 micro-Farads). Nevertheless, it should be recognized that the main capacitor 40 can be sized based on the available output of the receiver 12.

For the illustrated embodiment where the shock tube initiator 14 is adapted to receive an electrical pulse from a RAMS receiver, Table 1 shows values for each component of the electrical circuit, a manufacturer of each component and a model number of each component.

TABLE 1

| Component | Description | Manufacturer | Model No. |
|---|---|---|---|
| R1 | 12.1 KΩ | Vishay-Dale | CRCW12061212F |
| R2 | 15.0 KΩ | Vishay-Dale | CRCW12061502F |
| R3 | KΩ | Vishay-Dale | CRCW08053012F |
| R4 | KΩ | Vishay-Dale | CRCW08051401F |
| R5 | 500 Ω Trimpot | Copal Electronics | SM-4A501 |
| Q1 | MOSFET | International Rectifier | IRL2910S |
| D1 | Rectifier | Diodes Incorporated | HD02 |
| C1 and C2 | Tantalum Capacitor | Kemet | T491D685K035AS |
| VR1 | Voltage Reference | National Semiconductor | LM4050CIM3-10 |
| U1 | CMOS Buffer | Texas Instruments | CD4050BNSR |
| Main Capacitor | 2,300 micro-Farad | Cornell Dubilier | 101C232M100AA2A |

Figure 9:
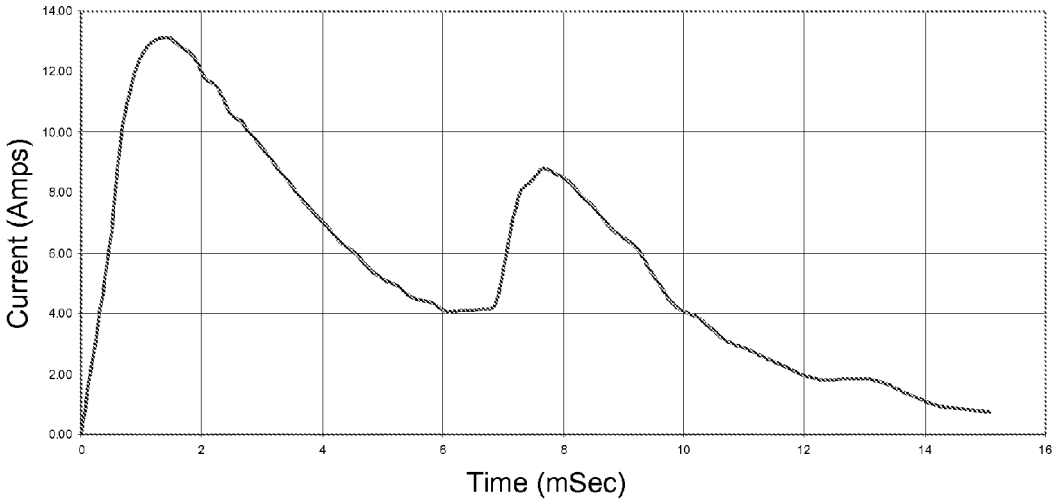
FIG. 9 is a graph of current versus time during a firing of the detonation initiator.

With additional reference to FIG. 9, shown is a graph of current through the coil 42 versus time during a discharge of the main capacitor 40 for the illustrated configuration of the shock tube initiator 14. During the first six milliseconds of the discharge, the core 58 of the linear actuator assembly 44 is accelerated from the starting position (e.g., with the firing pin 50 being spaced apart from the primer 20) toward a firing position (e.g., where the firing pin 50 impacts the primer 20 with sufficient energy to activate the primer 20). During this time, the current through the coil 42 peaks at about 13 amps and then decreases in a somewhat linear fashion. Following this time period a second current peak may be experienced, but the second current peak can be considered superfluous to operation of the shock tube initiator 14.

As indicated, the linear actuator assembly 44 has a DC resistance of about 2.8 ohms. The on resistance of the MOSFET Q1 is about 0.03 ohms and does not contribute significantly to the current load on the main capacitor 40. The linear actuator assembly 44 can be modified (e.g., by increasing or decreasing the DC resistance) to alter the current through the linear actuator assembly 44 during discharge of the main capacitor 40. However, application of a large amount of current in a relatively short time span may not result in sufficient movement of the core 58 (e.g., overcoming inertia of the core 58 to induce mechanical movement before the electrical energy appreciably falls off may not occur). On the other hand, if the main capacitor 40 is discharged too slowly, the core 58 may not achieve a desired velocity before the firing pin 40 comes in contact with the primer 20. As a result, the current through the linear actuator assembly 44 can be optimized to maximize transfer of electrical energy to mechanical energy. For instance, the time constant of the linear actuator assembly 44 can be matched to the time constant of the electrical circuit 38.

In addition, the mass of the core 58 can be selected such that the core 58 can be accelerated to delivery enough mechanical energy to the primer 20 to activate the primer 20. Mechanical energy is defined by the equation velocity squared times mass divided by two. In this regard, the mass should be small enough to be accelerated rapidly, but large enough to deliver sufficient energy. In the illustrated embodiment, the mass of the core 58 is about 164 milligrams. In this embodiment, the core can have a diameter of about 1.2 inches and the linear bearings can have a diameter of about one eighth of an inch.

If the electrical pulse supplied by the receiver 12 lasts longer than the time it takes to charge the main capacitor 40 to the threshold voltage and to discharge the capacitor, the main capacitor 40 may begin to recharge after a discharge. To minimize the possibility that the main capacitor 40 may reach the threshold charge and discharge more than once per electrical pulse, the electrical circuit 38 can be implemented to minimize the possibility of discharging the capacitor before half of the duration of the expected electrical pulse has expired. In one embodiment, the charge threshold can be set to be sufficiently high such that charging of the capacitor takes about one half of the duration of the electrical pulse.

As should be appreciated, the shock tube initiator 14 is relatively tolerant of the amount of power that can be delivered by the receiver 12. More specifically, the shock tube initiator 14 is arranged so that as long as there is sufficient power to charge the main capacitor 40 to the charge threshold during the duration of the electrical pulse, the linear actuator assembly 44 should be activated. Once activated in the manner described herein, the linear actuator assembly 44 should deliver enough mechanical energy to the primer 20 to activate the primer 20 regardless of how long the main capacitor 40 took to charge to the charge threshold.

In embodiments where the electrical pulse is delivered from a battery operated device, it is possible that the battery condition may be degraded to a point where the main capacitor 40 cannot become charged to the charge threshold during the duration of the electrical pulse. In this situation, no actuation of the linear actuator assembly 44 will take place as the main capacitor 40 will not be discharged by the electrical circuit 38. Ambient temperature is a leading factor on the battery's ability to sufficiently charge the main capacitor 40. In one embodiment, a thermistor can be added to the voltage divider or replace a resistor (R2, R4 or R5) of the voltage divider to lower the charge threshold for colder ambient temperatures and to raise the charge threshold for warmer ambient temperatures.

Although a specific embodiment of the shock tube initiator has been illustrated and described in detail, it is understood that the invention is not limited correspondingly in scope, but includes all changes, modifications and equivalents coming within the spirit and terms of the claims appended hereto.

What is claimed is:

1. A detonation initiator, comprising:

a moveable core having a permanent magnetic inner component connected to a concentric outer component to define an annular gap between the inner component and the outer component;

a coil disposed in the annular gap and adjacent the permanent magnetic inner component so that when a current is passed through the coil, the moveable core is propelled along a longitudinal axis of the moveable core; and a firing pin coupled to the moveable core to move with the moveable core.

2. The detonation initiator according to claim 1, further comprising:

a capacitor for storing electrical energy derived from an electrical pulse received by the detonation initiator; and an electrical circuit for monitoring charge on the capacitor and discharging the capacitor through the coil to propel the core along the longitudinal axis of the moveable core when the charge on the capacitor reaches a charge threshold.

3. The detonation initiator according to claim 2, wherein all operational power for the electrical circuit is derived from the electrical pulse.

4. The detonation initiator according to claim 1, further comprising a stanchion to support the coil in the annular gap.

5. The detonation initiator according to claim 4, wherein the stanchion is aluminum.

6. The detonation initiator according to claim 1, further comprising a bearing guide in which the moveable core is disposed, the bearing guide retaining linear bearings adjacent an exterior surface of the moveable core to guide the moveable core as the moveable core moves along the longitudinal axis.

7. The detonation initiator according to claim 1, wherein the firing pin is retained to the moveable core with a firing pin retainer.

8. The detonation initiator according to claim 7, further comprising a rolling flex seal that conforms to an upper surface of the firing pin retainer as the moveable core moves.

9. The detonation initiator according to claim 1, wherein the inner component is a magnet.

10. The detonation initiator according to claim 1, wherein the inner component includes a magnet contained in a housing.

11. The detonation initiator according to claim 10, wherein the housing is steel.

12. The detonation initiator according to claim 1, further comprising at least one spring to urge the moveable core to a starting position after propulsion of the moveable core.

13. The detonation initiator according to claim 12, further comprising a retraction rod that is coupled to the moveable core and wherein the at least one spring is connected to the retraction rod so that retraction force from the at least one spring is applied to the moveable core through the retraction rod.

14. A detonation initiator, comprising:

a moveable core that is moveable along a longitudinal axis of the moveable core;

a firing pin coupled to the moveable core to move with the moveable core; and a bearing guide in which the moveable core is disposed, wherein the bearing guide retains one or more linear bearings adjacent an exterior surface of the moveable core to guide the moveable core as the moveable core moves along the longitudinal axis.

15. The detonation initiator according to claim 14, wherein each linear bearing is retained by a corresponding through slot of the bearing guide.

16. The detonation initiator according to claim 14, wherein each linear bearing is secured to an interior surface of the bearing guide.

17. The detonation initiator according to claim 14, wherein each linear bearing is secured in a corresponding recess of the bearing guide.

18. The detonation initiator according to claim 14, wherein the linear bearings extend beyond an interior surface of the bearing guide to engage the exterior surface of the moveable core.

19. The detonation initiator according to claim 14, wherein the linear bearings are made from PFTE plastic.

20. The detonation initiator according to claim 14, further comprising at least one spring to urge the moveable core to a starting position after propulsion of the moveable core, and wherein each spring is disposed in a corresponding slot of the bearing guide.

21. The detonation initiator according to claim 14, wherein the bearing guide further includes an aperture for air to flow in and out of the bearing guide as a result of movement of the moveable core.

22. A detonation initiator, comprising:

a moveable core that is moveable along a longitudinal axis of the moveable core;

a firing pin;

a firing pin retainer that retains the firing pin to the moveable core so that the firing pin is moveable with the moveable core; and a rolling flex seal that conforms to the upper surface of the firing pin retainer as the moveable core moves.

* * * * *